US008346132B2

(12) United States Patent
Sato

(10) Patent No.: US 8,346,132 B2
(45) Date of Patent: Jan. 1, 2013

(54) IMAGE FORMING UNIT AND IMAGE FORMING DEVICE

(75) Inventor: Toshiharu Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 250 days.

(21) Appl. No.: 12/832,286

(22) Filed: Jul. 8, 2010

(65) Prior Publication Data

US 2011/0008070 A1 Jan. 13, 2011

(30) Foreign Application Priority Data

Jul. 10, 2009 (JP) ..... 2009-163531

(51) Int. Cl.
*G03G 15/02* (2006.01)

(52) U.S. Cl. ..... 399/176; 399/50; 399/168

(58) Field of Classification Search ..... 399/50, 399/168, 176, 115
See application file for complete search history.

(56) References Cited

U.S. PATENT DOCUMENTS

2004/0057749 A1* 3/2004 Saito et al. ..... 399/109
2008/0292366 A1* 11/2008 Akama et al. ..... 399/286

FOREIGN PATENT DOCUMENTS

JP A-2000-075701 3/2000
JP A-2007-178559 7/2007

* cited by examiner

*Primary Examiner* — Walter L Lindsay, Jr.
*Assistant Examiner* — Roy Y Yi
(74) *Attorney, Agent, or Firm* — Posz Law Group, PLC

(57) ABSTRACT

An image forming unit has a rotatable electrostatic latent image carrier, a charge member positioned to contact the electrostatic latent image carrier and charge a surface of the electrostatic latent image carrier, and a developing part, which supplies a developer to the electrostatic latent image carrier for obtaining a developer image. The charge member includes a conductive elastic layer and a surface layer formed on a circumferential surface of the conductive elastic layer. The surface layer contains particles having an average particle size of 5 μm-20 μm; and a ratio of a surface area per unit area of the surface layer is in a range from 1.5 to 3.0.

18 Claims, 9 Drawing Sheets

| D/S | | Micro-Particle Size D [μ/m] | | | | |
|---|---|---|---|---|---|---|
| | | D<5 | 5≦D<10 | 10≦D<15 | 15≦D<20 | 20<D |
| Ss/Sa=S | 1.0~1.4 | × | × | × | × | × |
| | 1.5~2.4 | × | ○ | ○ | ○ | × |
| | 2.1~2.5 | × | ○ | ○ | ○ | × |
| | 2.6~3.0 | × | ○ | ○ | ○ | × |
| | 3.1~3.5 | × | × | × | × | × |

Fig.8

| D/S | | Micro-Particle Size D [μ/m] | | | | |
|---|---|---|---|---|---|---|
| | | D<5 | 5≦D<10 | 10≦D<15 | 15≦D<20 | 20<D |
| Ss/Sa=S | 1.0~1.4 | 3/1.4 | 6/1.2 | 11/1.3 | 17/1.0 | 23/1.3 |
| | 1.5~2.4 | 4/1.6 | 5/1.5 | 11/1.7 | 20/1.5 | 21/1.6 |
| | 2.1~2.5 | 3/2.1 | 7/2.3 | 13/2.4 | 18/2.2 | 23/2.2 |
| | 2.6~3.0 | 3/2.6 | 5/3.0 | 14/2.8 | 20/3.0 | 21/2.7 |
| | 3.1~3.5 | 4/3.3 | 8/3.4 | 12/3.3 | 16/3.1 | 24/3.2 |

Fig.9

$5 \leqq D \leqq 20$
$1.5 \leqq S \leqq 3.0$
$D/2 \leqq Rz \leqq D$
$D \leqq Ry \leqq 2D$

IMAGE FORMING UNIT AND IMAGE FORMING DEVICE

CROSS REFERENCE

The present application is related to, claims priority from and incorporates by reference Japanese patent application number 2009-163531, filed on Jul. 10, 2009.

TECHNICAL FIELD

The present invention relates to an image forming unit and an image forming device using this image forming unit.

BACKGROUND

Conventionally, in an image forming unit in an image forming device, such as an electrographic printer or photocopier, in order to stably charge the surface of a photosensitive drum, minute voids are formed between the surface of the charge roller and the surface of the photosensitive drum by covering an outer circumferential surface of the charge roller with a semi-conductive resin coat layer containing particles of magnesium oxide, which is an electric insulator, with a particle size (or average particle diameter) of 15 μm-50 μm. The outer circumferential surface of the charge roller has asperity, or roughness, due to the particles of magnesium oxide. Such technology is described in Japanese laid-open application publication number 2000-75701.

However, in the conventional image forming unit, when this unit is left idle for a long time, deformation marks occur on an area of contact between the charge roller and the photosensitive drum, which may cause deterioration of image quality. The objective of the present invention is to improve the image quality.

SUMMARY

For such an object, an image forming unit disclosed in the application includes a rotatable electrostatic latent image carrier; a charge member that is positioned to contact the electrostatic latent image carrier and that charges a surface of the electrostatic latent image carrier; and a developing part that supplies a developer to the electrostatic latent image carrier for obtaining a developer image. The charge member includes a conductive elastic layer and a surface layer formed on a circumferential surface of the conductive elastic layer; the surface layer contains particles having an average particle size of 5 μm-20 μm; and a ratio of a surface area per unit area of the surface layer is in a range from 1.5 to 3.0.

Also, another image forming unit disclosed in the application includes an electrostatic latent image carrier, wherein an electrostatic latent image is formed on a surface of the electrostatic latent image carrier; and a rubber roller that contacts the electrostatic latent image carrier. The rubber roller has an axial shaft, a conductive elastic layer formed about an outer circumference of the shaft, and a surface layer formed on an outer-circumferential surface of the conductive elastic layer; the surface layer contains particles, which have an average particle size of 5 μm-20 μm, in a dispersed manner; and a ratio of a surface area per unit area of the surface layer is in a range from 1.5 to 3.0.

In the embodiments disclosed in the present application, the improvement of the image quality is realized.

BRIEF DESCRIPTION OF THE DRAWINGS

FIG. 8 is an explanatory table indicating the relationship among the surface areas of the micro-particle size and the surface area per unit area in FIG. 3 and the print quality of the image forming unit in FIG. 1.

FIG. 9 is an explanatory table indicating an actual example of FIG. 8.

DETAILED DESCRIPTION

An explanation of preferred embodiments with reference to the attached drawings follows. However, the drawings are merely for commentary, and are not intended to limit the scope of the present invention.

First Embodiment

Configuration of First Embodiment

Figure 1:
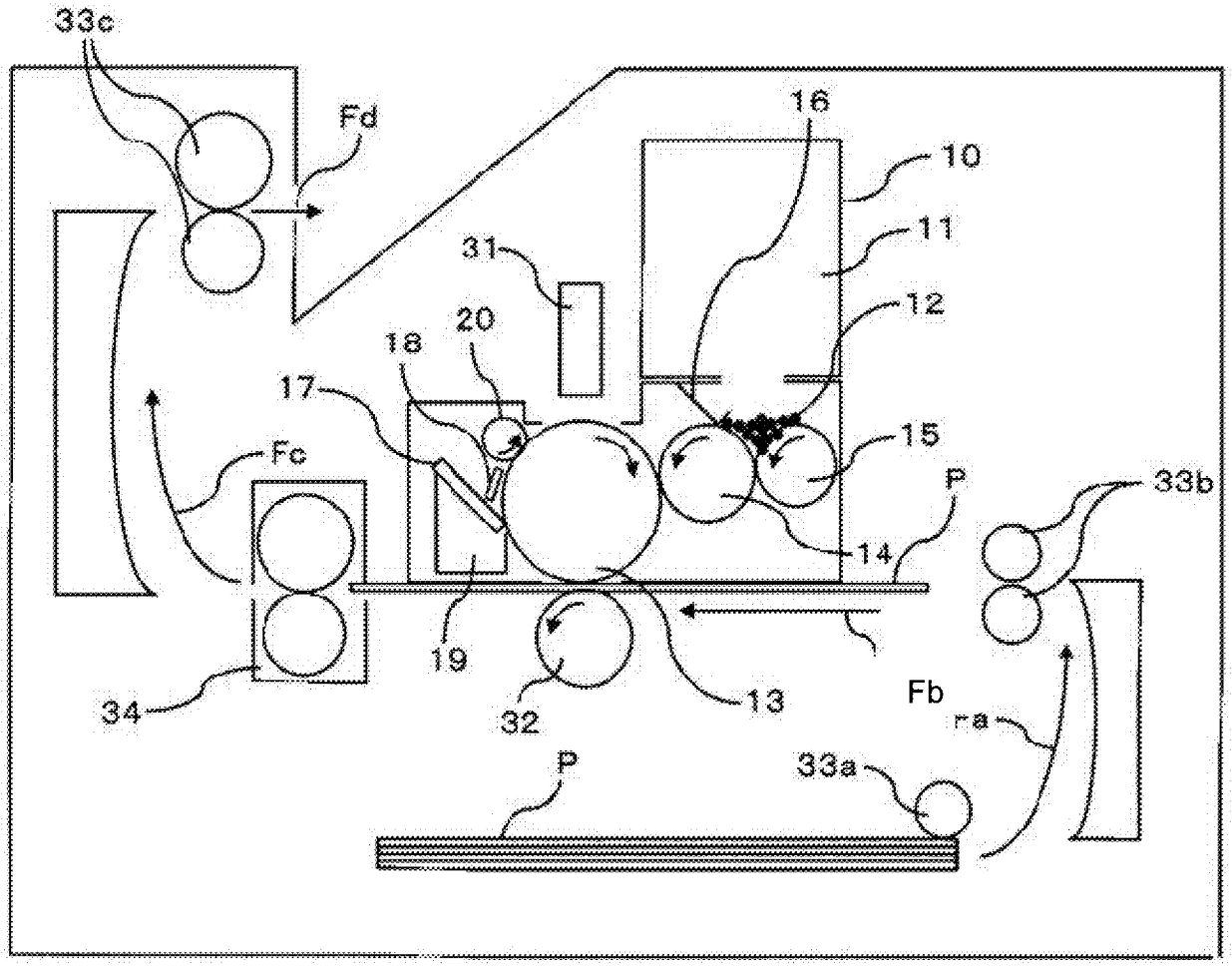
FIG. 1 is a configuration diagram illustrating a first embodiment of an image forming device of the present invention.

FIG. 1 is a configuration diagram illustrating an image forming device according to a first embodiment of the present invention.

The image forming device is, for example, a printer, and has an image forming unit 10. The image forming unit 10 internally contains a developer (for example, a toner) 12 replenished from a toner cartridge 11, and has an electrostatic latent image carrier (for example, a photosensitive drum) 13, a rotatable developer carrier (for example, a developing roller) 14 arranged by facing the photosensitive drum 13, and a developer supply member (for example, a supply roller) 15 for supplying a toner 12 to the developing roller 14. The developing roller 14 and supply roller 15 form the developing part. The photosensitive drum 13 is rotated in the direction of the arrow; concurrently, the developing roller 14 and the supply roller 15 are rotated in the directions of the arrows, respectively, as shown.

In addition, the image forming unit 10 has a charge member (for example, a charge roller) 20 that charges the photosensitive drum 13; a toner layer thickness regulatory blade (for example, a developing blade) 16 that forms a thin layer of the toner 12 supplied onto the developing roller 14; a cleaning blade 17 for collecting and transferring toner 12 that remains on the photosensitive drum 13; a discharging device 18 for removing the remaining potential on the photosensitive drum 13; and a toner receiving part 19 in which a member (such as a screw) for carrying the toner (waste toner) 12 scraped by the cleaning blade 17 to a collector container is accommodated.

The photosensitive drum 13, the developing roller 14, the supply roller 15 and the charge roller 20 are rotated in the illustrated directions, respectively.

Furthermore, the charge roller 20 is composed of a rubber roller, which is applicable not only to the charge roller 20 but also, for example, to the developing roller 14 and the unillustrated cleaning roller.

A print head 31 that emits a plurality of dots of lights by a light-emitting diode (hereafter, referred to as "LED") or a laser beam, etc., and that forms an electrostatic latent image on the photosensitive drum 13; a transfer roller 32 that transfers the toner 12 on the photosensitive drum 13 onto a sheet P due to an electrical field generated by applied voltage; and a fuser 34 that fuses the toner on the sheet P due to heat are arranged around the periphery of the image forming unit 10. A sheet cassette (not-illustrated) is placed at the lower side of the image forming unit 10, and the sheets P, which are recording media, are contained in the sheet cassette. The sheets P are fed one at a time by a sheet carrying roller 33*a* and travel in the Fa direction. A sheet carrying roller 33*b* is a roller for drawing the sheet P into the image forming unit 10, and the sheet carrying roller 33*c* is a roller for ejecting the printed sheet P to the outside of the image forming device. The sheet P is carried in the directions of the arrows Fa, Fb, Fc and Fd by the movements of the carrying rollers 33*a*, 33*b* and 33*b*.

Figure 2:
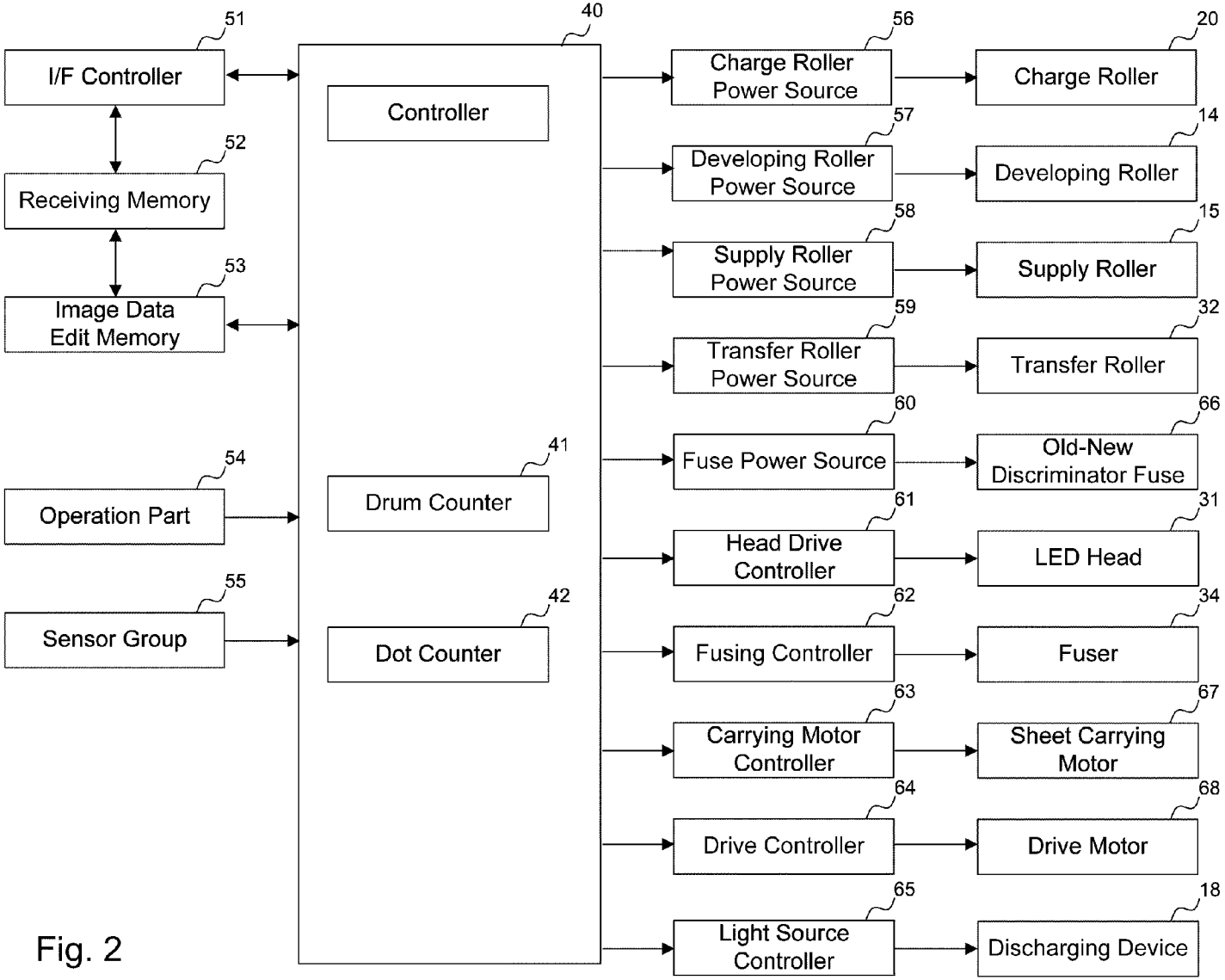
FIG. 2 is a functional block diagram illustrating a circuit configuration in the image forming device of FIG. 1.

FIG. 2 is a functional block diagram illustrating a circuit configuration of the image fanning device in FIG. 1. The image forming device has a controller 40 for controlling the entire device. The controller 40 (not illustrated) includes of a microprocessor, a read-only-memory (hereafter, referred to as "ROM"), a random-access-memory (hereafter, referred to as "RAM"), an input/output port and a timer, etc. The controller 40 has the function of receiving print data and control commands from a host device (not-illustrated) via an interface controller (hereafter, referred to as "I/F controller") 51 due to the control of a program stored in the ROM, to control an entire sequence of the image forming device, and to print the data. The controller 40 has a drum counter 41 that counts the number of rotations of the photosensitive drum 13 and a dot counter 42 that counts print dots.

Receiving memory 52 is included in the RAM, and has the function of temporarily recording the print data entered from the host device via the I/F controller 51. The image data edit memory 53 is a memory part that receives the print data recorded in the receiving memory 52 and that records image data edited and processed into image data by the controller 40.

An operation part 54 is equipped with an LED, for displaying the status of the image forming device and switches, and a display part, for providing instructions to the image forming device from an operator. A sensor group 55 includes various sensors for monitoring the performance status of the image forming device, such as a sheet position detecting sensor, a temperature-humidity sensor or a concentration sensor.

A charge roller power source 56, which serves as a first power source, applies voltage to the charge roller 20 according instructions from the controller 40, and charges the surface of the photosensitive drum 13. A developing roller power source 57, which serves as a second power source, applies predetermined voltage to the developing roller 14 in order to attach the toner 12 onto an electrostatic latent image on the photosensitive drum 13. A supply roller power source 58, which serves as a third power source, applies predetermined voltage to the supply roller 15 in order to supply the toner 12 to the developing roller 14. A transfer roller power source 59, which serves as a fourth power source, applies predetermined voltage to the transfer roller 32 in order to transfer the toner image formed on the photosensitive drum 13 onto the sheet P. Furthermore, the charge roller power source 56, the developing roller power source 57 and the supply roller power source 58 are designed to change the voltage according to instructions from the controller 40.

An old-new discriminator fuse 66 is a fuse for discriminating whether or not the image forming unit 10 has been used, and a fuse power source 60 is a power source for flowing electric current into the old-new discriminator fuse 66. A head drive controller 61 is a controller that sends the image data recorded in the image data edit memory 53 to a print head 31 (for example, LED head), and that drives the print head 31. A fusing controller 62 is a controller that applies voltage to the fuser 34 as a fusing means, in order to fuse the toner image transferred to the sheet P. The fuser 34 is equipped with a not-illustrated heater for inciting the toner 12 composing the toner image on the sheet P, and a not-illustrated temperature sensor that detects temperature, etc. The fusing controller 62 reads the sensor output of the temperature sensor, and controls the fuser 34 to be constant temperature by applying electric current to the heater based on the sensor output.

A carrying motor controller 63 is a controller that controls a sheet carrying motor 67 for carrying the sheet P, and the carrying motor controller 63 carries or stops the sheet P at a predetermined time according to instructions from the control part 40. A light source controller 65 controls light emission of the discharging device 18 and irradiates a discharge light to the surface of the photosensitive drum 13. The drive controller 64 is a controller that drives a drive motor 68 for operating the photosensitive drum 13, and the drive motor 68 is driven by the drive controller 64. The drum counter 41 counts the number of rotations of the photosensitive drum 13. In addition, the dot counter 42 has the function of counting print dots.

Figure 3B:
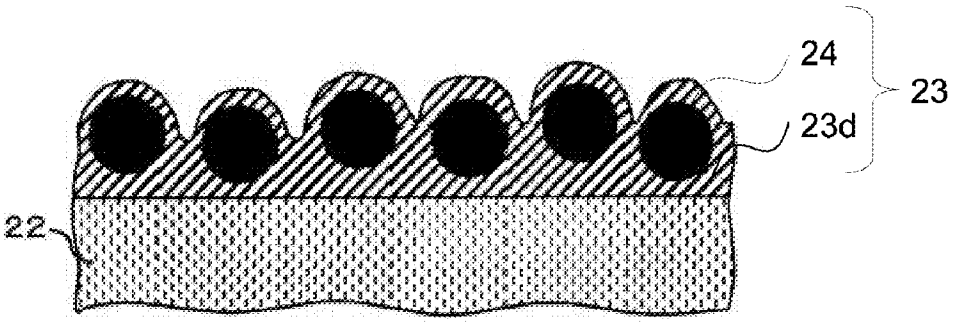
FIG. 3B is a cross sectional diagram taken along the line A1-A2 in FIG. 3A.
Figure 3A:
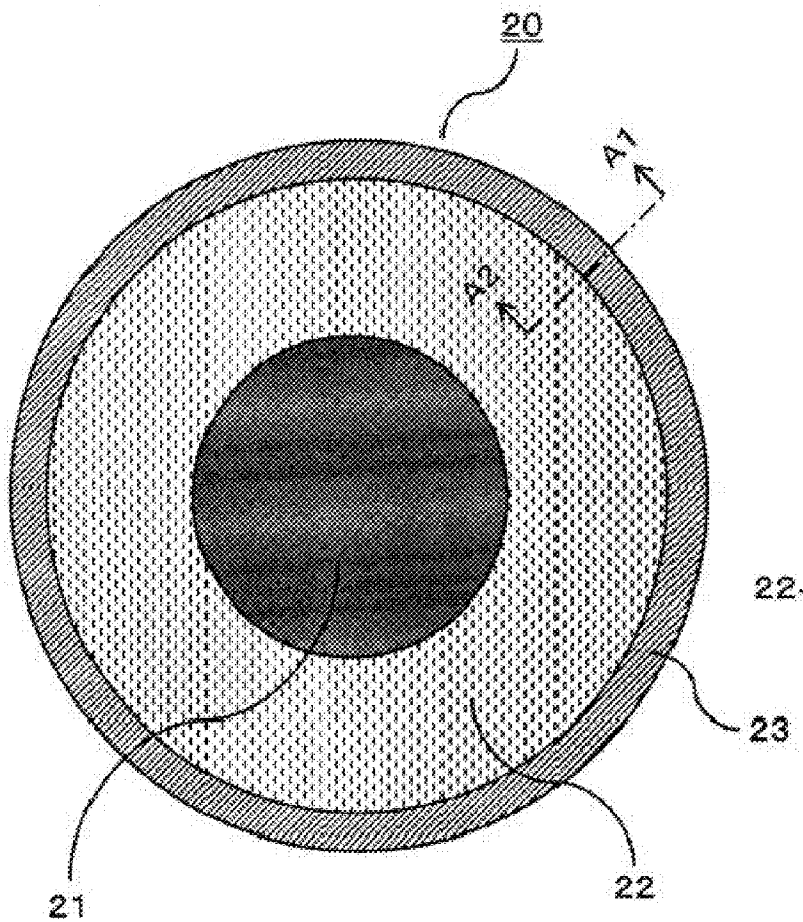
FIG. 3A is a cross sectional diagram illustrating the charge roller in FIG. 1.
Figure 4:
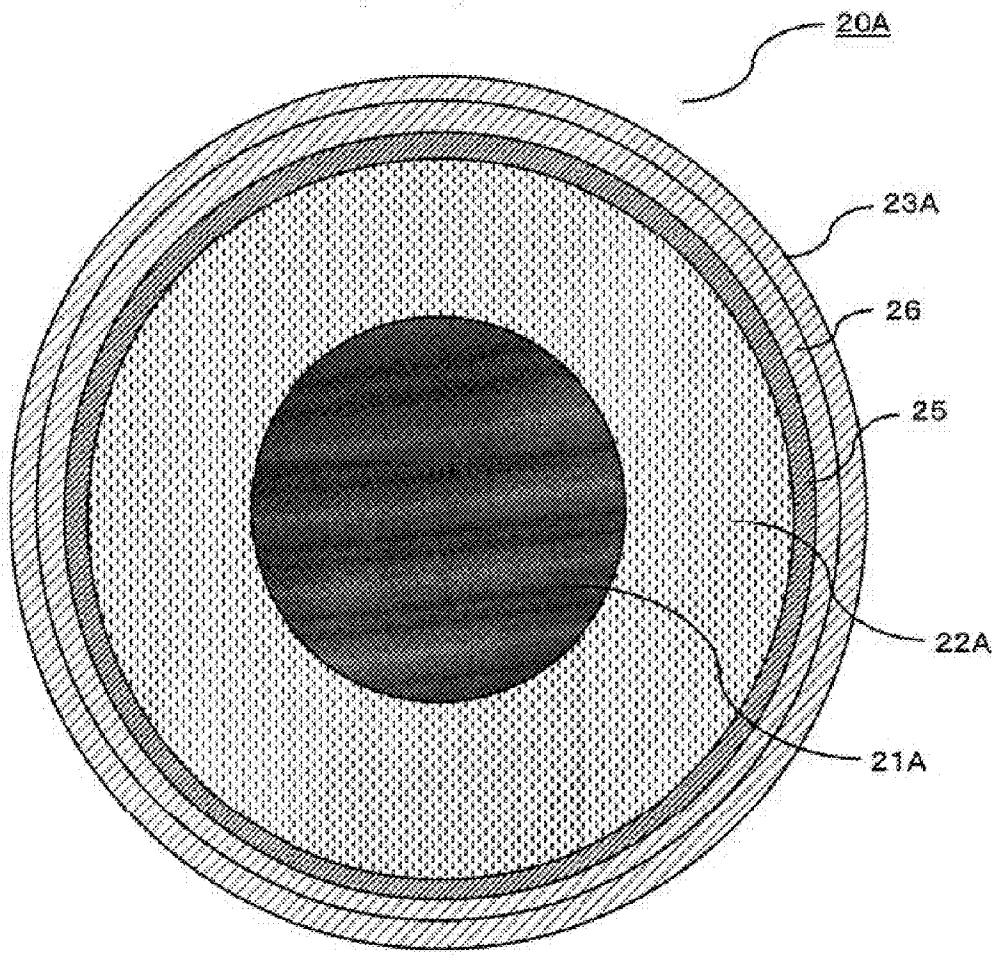
FIG. 4 is a cross sectional diagram illustrating a modified example of the charge roller in FIG. 2.

FIG. 3A and FIG. 3B are configuration diagrams illustrating the outline of the charge roller in FIG. 1, and FIG. 4 is a configuration diagram illustrating a modified example of the charge roller in FIG. 2.

FIG. 3A is a cross-sectional axial view of the charge roller 20, and FIG. 3B is a cross-sectional view of A1-A2. The charge roller 20 is equipped with a shaft body (for example, a shaft) 21 and a conductive base layer 22 around its periphery, and a surface layer 23 is placed on its outermost surface for providing durability and resistance to staining. The conductive base layer 22 is a layer having conductivity and flexibility and is configured with various compositions. The conductive base layer 22 can also be defined as a conductive elastic layer. A softener migration prevention layer 25 or a resistance adjusting layer 26, which serves as an intermediate layer, may be established between the conductive base layer 22 and the surface layer 23 as shown in FIG. 4. Particles (for example, micro-particles) are dispersed and contained in the surface layer 23, and minute asperity is formed on the outer circumferential surface of the surface layer 23. The softener migration prevention layer 25 is a resin layer established for preventing softener from leaking from a conductive base layer 22A. The resistance adjusting layer 26 adjusts the charge roller 20A to a predetermined resistance value at the resistance adjusting layer 26 when the resistance adjustment is insufficient at the conductive base layer 22A. The resistance adjusting layer 26 is, for example, a rubber composition where an ion conductant agent is blended into any one of epichlorohydrin-ethylene oxide copolymer rubber, epichlorohydrin rubber, hydrogenated nitrile rubber and acrylic rubber. Volume resistivity of the resistance adjusting layer 26 is adjusted to be $10^7$-$10^{10}$ Ω·cm, preferably approximately $10^8$ Ω·cm. In this embodiment, the intermediate layer is disclosed as a two-layer structure. However, the intermediate layer can be either one of the softening agent transition prevention layer 25 or the resistance adjusting layer 26. It is also possible to establish a layer having other function(s) as an intermediate layer.

The shaft 21 can be formed from any metal having predetermined rigidity, concurrently, and sufficient conductivity. For example, iron, copper, brass, stainless, aluminum and nickel are used. Further, even materials other than metal, which have conductivity and appropriate rigidity, may be used. For example, resin molded articles where conductive particles are dispersed or ceramics, etc. can also be used. In addition to the roll shape, a hollow pipe shape is practical.

The conductive base layer 22 has length satisfying an image print region, and is preferably a resistance layer whose volume specific resistance is $10^6\Omega\cdot$cm or less. As for the layer 22, a material is used that has 10 degrees to 40 degrees of JIS-A hardness, which is easily deformed and which excels in a deformation recovery property. For example, any one type of known rubber materials, such as ethylene-propylene rubber, polybutadiene, natural rubber, polyisobutylene, chloroprene rubber, silicone rubber, urethane rubber, epichlorohydrin rubber, phlorosilicone rubber, ethyleneoxide rubber, styrene-butadiene rubber, nitrile rubber or acrylic rubber is selected, or a plurality of types are combined and used. Alternatively, a foam material where these materials are foamed is used.

Then, as conductive particles or semiconductor particles, carbon black, metal, metal oxide or an ionic compound can be singularly used or two or more types of them can be mixed and used in such elastic material. For the metal, zinc, aluminum, copper, iron, nickel, chrome, titanium or the like is practical. For the metal oxide, $ZNO—AL_2O_3$, $SNO_2—SB_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO MgO or the like is practical. For the ionic compound, quaternary ammonium salt or the like is practical. In addition, one or more types of an inorganic filler material, such as talc, alumina or silica, and an organic filler material, such as fine powder of fluorine resin or silicone rubber, may be mixed as needed.

A material of the surface layer 23 is a binder resin 23*d* where the micro-particles 24 are dispersed, and if the volume resistivity is too low, it leaks and if the volume resistivity is too great, the photosensitive drum 13 cannot be stably charged; therefore, a range from $10^5$ to $10^{10}$ $\Omega\cdot$cm is preferable. Further, if the average film thickness is too small, the material might not function sufficiently to prevent contamination, such as bleed or blooming, and if the average film thickness is too great, the hardness of the surface layer 23 becomes great and flexibility as a roll becomes less; therefore, the film thickness of the surface layer 23 is preferably in a range from 0.01 μm to 1,000 μm. As the binder resin 23*d*, acrylic resin, cellulose resin, polyamide resin, methoxy methylated nylon, ethoxy methylated nylon, polyurethane resin, polycarbonate resin, polyester resin, polyethylene resin, polyvinyl resin, polyarylate resin, polythiophene resin, polyolefin resin (such as PFA, FEP or PET), styrene-butadiene resin, melamine resin, epoxy resin, urethane resin, silicone resin and urea resin are used.

For the micro-particles 24 dispersed in the surface layer 23, one or more types of carbon black, metal or metallic oxide, and an ionic compound (such as quaternary ammonium salt creating ion conductivity) are mixed as similar to the conductive base layer 22. Further, according to its necessity, one or more types of an antioxidant such as hindered phenol or hindered amine; an inorganic filler, such as clay, kaolin, talc, silica or alumina; an organic filler, such as fluorine resin or silicone resin; and a lubricant agent, such as silicone oil, can be added. In addition, a surfactant or a charge controlling agent, etc. is added as needed.

As a means to form the surface layer 23, a blade coating method, a Mayer-Bar Coating method, a spray coating method, an immersion coating method, a speed coating method, an air knife coating method, and a curtain coating method etc. are usable.

(Performance of Entire Image Forming Device in First Embodiment)

According to FIG. 1 and FIG. 2, the entire performance of the image forming device and the image forming unit 10 is explained.

The controller 40 has the receiving memory 52 received print data from a host device via the I/F controller 51, and performs a printing operation by controlling sequences of the entire image forming device. The controller 40 converts the received print data into image data, and stores the data in the image data edit memory 53. Then, the sheet carrying motor 67 receives a signal from the carrying motor controller 63 and carries the sheet P at the predetermined time. The sheet P fed by the sheet carrying roller 33*a* is carried in the direction of the arrow Fa, and passes through the sheet carrying rollers 33*b*. The sheet P passes the sheet carrying rollers 33*b* and is carried in the direction of the arrow Fb under the image forming unit 10. The toner 12 is transferred to the sheet P at a contact area between the photosensitive drum 13 and the transfer roller 32 due to physical pressure and electric electrostatic force.

The process of the image forming unit 10 up to the transfer of the toner 12 starts from the transmission of control data from the controller 40 to the drive controller 64 and a rotation of the photosensitive drum 13 by the drive motor 68. The charge roller 20 is rotated on the surface of the rotated photosensitive drum 13. The charge roller power source 56 that has received the print data from the controller 40 applies negative voltage to the charge roller 20 so that the photosensitive drum 13 is negatively charged. The charged photosensitive drum 13 is exposed by the print head 31 (or LED head) controlled by the head drive controller 61, and an electrostatic latent image is formed on the surface of the exposed photosensitive drum 13. Then, the toner 12 is provided to the developing roller 14 so that an image is developed.

The toner 12 is supplied to the developing roller 14 from the supply roller 15. To the developing roller 14 bias and the supply roller 15 bias at that time, voltage instructed by the controller 40 is applied by the developing roller power source 57 and the supply roller power source 58. The toner 12 supplied onto the developing roller 14 is formed to be a thin layer by passing through the developing blade 16. Further, the toner 12 within the image forming unit 10 is supplied by the toner cartridge 11. After the toner 12 is transferred to the sheet P from the photosensitive drum 13, the toner remaining in the photosensitive drum 13 is removed by a cleaning blade 17 and discarded to a not-illustrated waste toner box by a screw in a toner receiving part 19. In the sheet P where the toner image has been transferred, the toner image is fused to the sheet P by passing through the fuser 34 controlled by the fusing controller 62. After fusing, the sheet P is carried in the direction of the Fc arrow, and is carried in the Fd arrow direction to the outside of the image forming device by passing through the carrying rollers 33*c*.

(Performance of Charge Roller in the First Embodiment)

The performance of the charge roller 20 in the first embodiment is explained by the example shown in FIG. 3.

The charge roller 20 of the first embodiment has a two-layer structure with the conductive base layer 22 and the surface layer 23. A SUM 23L is used for the shaft 21; epichlorohydrin rubber is used for the conductive base layer 22; nylon resin is used for the surface layer 23; and polymethylmethacrylate is used for the micro-particles 24. In the charge roller 20, convex portions are formed on the surface layer 23 by the micro-particles 24. As a result, on the surface layer 23, a difference in height occurs between the section where the convex portions are formed and adjacent areas where no convex portion is formed, and micro-voids are formed between the surface of the photosensitive drum 13 due to this difference in height. Discharging occurs in these micro-voids, and a charge is applied to the photosensitive drum 13 from the charge roller 20.

At this time, in the conventional image forming unit 10, if the image forming unit 10 is left for a long time, marks occur on the abutting surface between the photosensitive drum 13 and the charge roller 20, with the problem that a charge failure occurs. In the first embodiment, the relationship among the particle size of the micro-particles 24 and the surface area per unit area of the surface layer 23 and the printing quality of the image forming unit 10 was clarified according to an experiment.

Figure 5B:
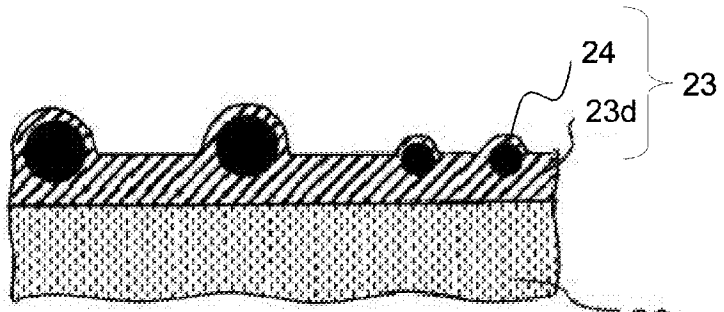
FIGS. 5A-5C are explanatory cross sectional diagrams illustrating a status of a surface layer in the charge layer in FIG. 1.
Figure 5C:
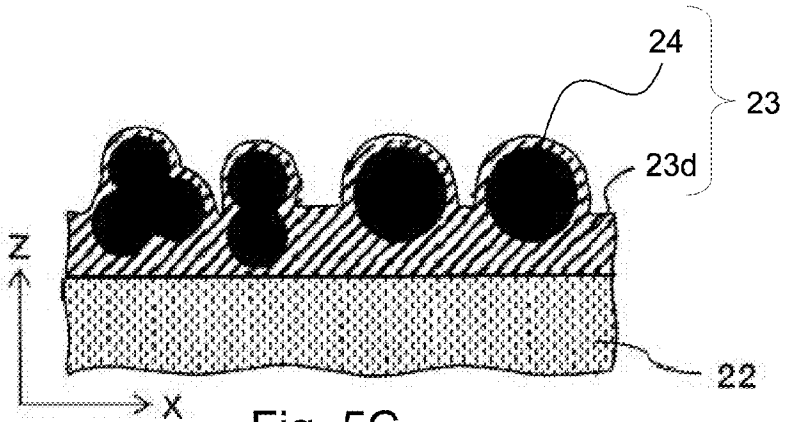
Figure 5A:
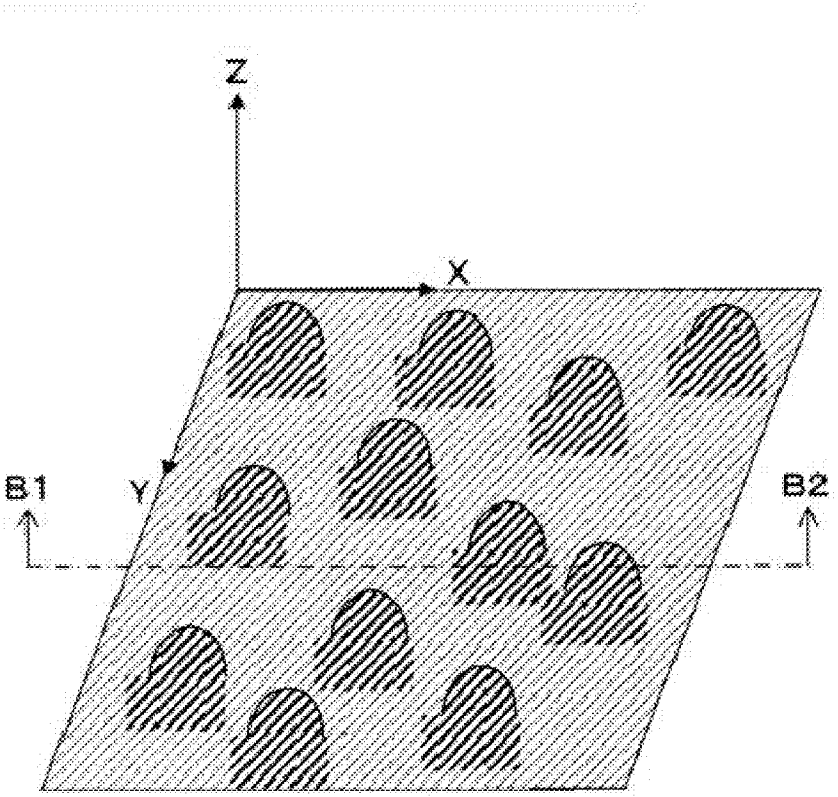

FIGS. 5A-5C are explanatory diagrams illustrating a status of the surface layer of the charge roller in FIG. 1, respectively.

FIG. 5A is an enlarged diagram of the surface layer 23 observed by a microscope. FIGS. 5B and 5C are cross section views taken along lines B1-B2, respectively. The symbol "Z" indicates a vertical direction, and "X" and "Y" indicate horizontal directions, respectively.

The surface layer 23 was observed with 1,000 times optical magnification. Such an observed area is referred to as Sa. Three-dimensional analysis in the observed surface layer 23 results in an obtainment of the surface area Ss including the asperity in the Z-axis direction in the area Sa. The symbol S indicating area density was obtained with the following expression with the area Sa and the surface area Ss:

$$S=Ss/Sa$$

When the particle size D was small or an additive amount of the micro-particles 24 was less, the condition was as shown in FIG. 5B, and since the surface Ss was small, the value of S was small. Inversely, when the particle size D was great or the additive amount of the micro-particles 24 was great, the condition was as shown in FIG. 5C, and since the area was large, the value of S became large. Furthermore, in order to increase the surface area Ss, there are the following alternative methods (1)-(4):

(1) Add micro-particles 24 with greater particle size to the surface layer 23.

(2) Increase the number of sections of micro-particles 24 to be added.

(3) Slow the coating speed of the surface layer 23.

(4) Increase the number of coating processes to the surface layer 23.

Figure 6B:
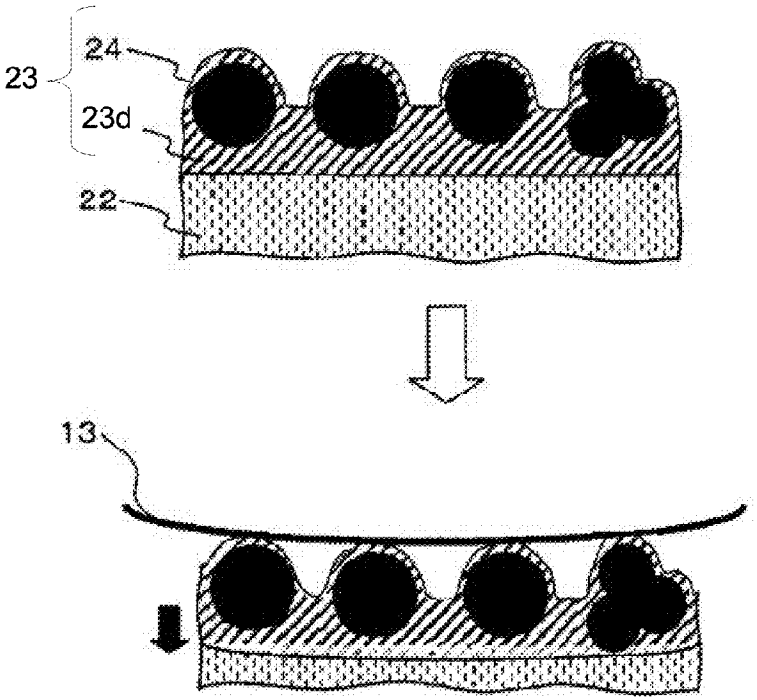
FIGS. 6A and 6B are explanatory cross sectional diagrams illustrating an occurrence status of marks in the charge roller in FIG. 1.
Figure 6A:
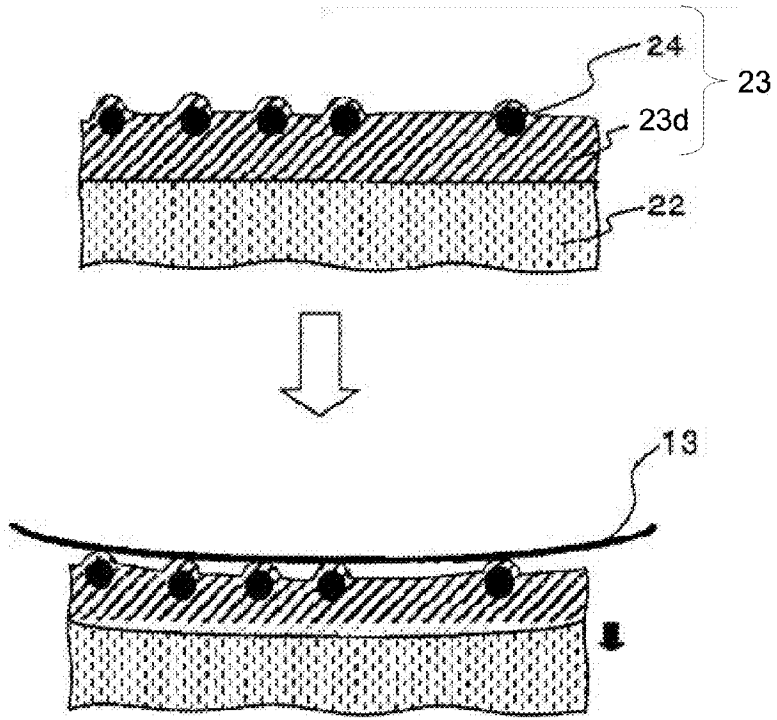
Figure 7B:
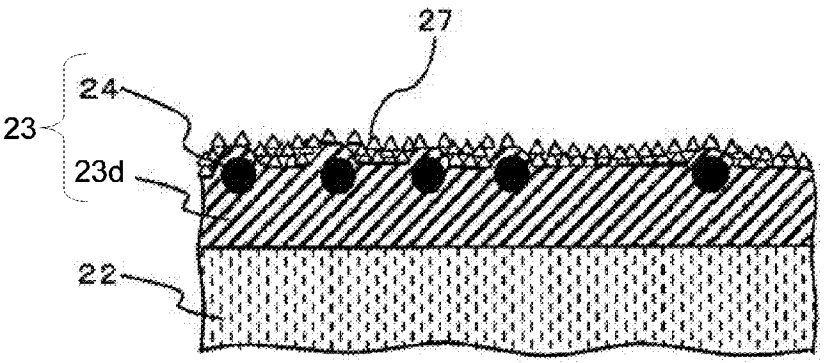
FIGS. 7A and 7B are explanatory cross sectional diagrams illustrating a deposition status of an external additive to the charge roller in FIG. 1.
Figure 7A:
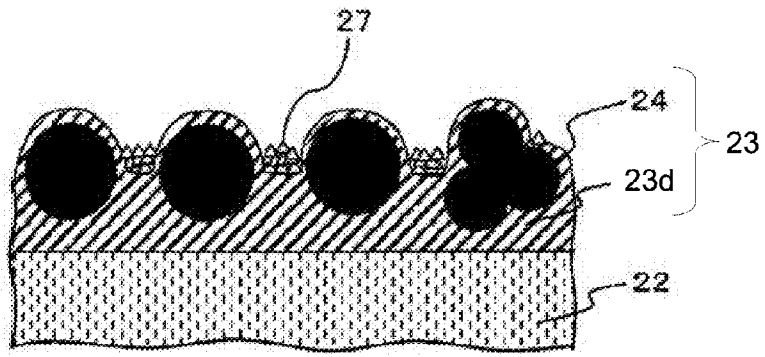

FIGS. 6A and 6B are explanatory diagrams illustrating the occurrence status of the marks on the charge roller in FIG. 1, respectively, and FIGS. 7A and 7B are explanatory diagrams illustrating the deposition status of an external additive to the charge roller in FIG. 1, respectively.

FIG. 6A is a cross-sectional view of the surface layer 23 in the case where the particle size of the micro-particles 24 is small, and FIG. 6B is a cross-sectional view of the surface layer 23 in the case where the particle size of the micro-particles 24 is large. FIG. 7A is a cross-sectional view of the surface layer illustrating the deposition of an external additive in the case where the particle size of the micro-particles 24 is large, and FIG. 7B is a cross-sectional view of the surface layer illustrating the deposition of the external additive in the case where the particle size of the microparticles 24 is small.

Since the charge roller 20 is pressed with the predetermined pressure of the springs by the photosensitive drum 13, pressure is applied to the surface layer 23 radially in the direction of the shaft 21. Consequently, as shown in FIG. 6B, in the state where the particle size D is large or micro-particles 24 are deposited, the amount of the micro-particles 24 pressed due to the pressure is relatively high, and the amount of the conductive base layer 22 to be deformed due to the pressure is relatively high. Therefore, permanent strain resulting from the long-term application of pressure is great, and the photosensitive drum 13 cannot be charged by a predetermined amount on the strained surface. As a result, black bands, which extend in a lateral direction, occur and correspond to the strain formed on the charge roller 20. The black bands are formed on the printed sheets P according to the rotation period of the charge roller.

As shown in FIG. 7B, the external additive 27 that forms the toner 12 to be used for the image forming unit 10 separates from the toner 12 due to various processes and stress during printing. The separated external additive 27 reaches the charge roller 20 via the photosensitive drum 13 and is deposited on the surface layer 23 of the charge roller 20. A method of removing the external additive 27 by a cleaning mechanism of the charge roller 20 is known. However, in the image forming unit 10, which lacks a cleaning mechanism, the external additive 27 adheres to the surface layer 23 and expands due to the contacting and pressing force of the photosensitive drum 13, and the photosensitive drum 13 cannot be stably charged and print defects, such as scratched smears, concentration reduction or granular deterioration, occur.

When the external additive 27 is attached to the surface of the charge roller 20, the charge roller 20 becomes an insulator and will fail to charge the photosensitive drum 13. As a result, the drum potential becomes low so that the thickness of the toner image formed on the surface of the photosensitive drum 13 increases. Then, the relatively thick toner image is transferred to and fixed on the sheet P. Accordingly, the image density on the sheet P is high, which causes the image quality to deteriorate.

As shown in FIG. 7B, when the micro-particles 24 are small, because the asperity is small, the external additive 27 is deposited and adhered over the entire surface of the surface layer 23 regardless of peaks and troughs. Further, in the state where a ratio of the micro-particles 24 to the surface layer 23 is small or when the dispersal of the micro-particles is poor, the external additive 27 is deposited, spreads, and adheres where there is no asperity. Furthermore, as shown in FIG. 7A, when the micro-particles 24 are large, the external additive 27 is deposited and adhered in a section where no micro-particle 24 is present, but because the convex portion is still present, it is possible to stably charge the photosensitive drum 13.

FIG. 8 is an explanatory diagram illustrating a relationship among the micro-particle size and the surface area per unit area in FIG. 3 and print quality of the image forming unit in FIG. 1. In addition, FIG. 9 is an explanatory diagram illustrating an actual example of FIG. 8.

FIG. 8 shows evaluation results of the first embodiment. FIG. 8 shows a region to satisfy the print quality with a matrix of the particle size D of the micro-particles 24, and the value S of the surface area Ss per unit area Sa of the surface layer 23. For the particle size D of the micro-particles 24, the average particle size (average diameter) was 3 μm and up to 24 μm. The particle size D at that time is a value measured using an ultra-deep shape measuring microscope (VK-8500 manufactured by KEYENCE), and this was an average particle size calculated from thirty two particles that were randomly-selected. The value S for the surface area Ss per unit area Sa is an index indicating the surface density of the surface layer 23.

Herein, an ultra-depth measuring method using an ultra-deep shape measuring microscope is explained. Ultra-depth measurement and its analysis synthesize color and luminance, which are the information of a camera used when the camera focuses on each pixel; and display a three-dimensional color image with deep depth of focus, and analyze the obtained three-dimensional image using an analyzer. Hereafter, the procedures are explained by dividing into (1) to (6) in order.

(1) Adjust a charge-coupled device (CCD) image (a) Place a subject to be measured on a stage (b) Select "color raw image" in "VIEWMODE"

(c) Set "Auto" for shutter speed (d) Focus the camera by adjusting a focusing handle (2) Select RUNMODE (e) Select "Color ultra-depth" in "RUNMODE"

(3) Adjust a light receiving gain (f) Set the light receiving gain to "Auto"

(g) Click "Start measurement" button (4) Set Distance Pitch (h) Click "lens position shift", and raise the lens until a position where the image is no longer focused (i) Click "H" button (j) Click "lens position shift", and lower the lens until a position where the image is no longer focused (k) Click "L" button (l) Enter "PITCH"

(5) Start measurement

The measurement conditions as follows:

Objective lens magnification: 20× (20 times)

Magnification on 15-inch monitor: 400×

PITCH: 1-5 μm; however, it depends upon the height of a subject to be measured (6) Analyze the three-dimensional image obtained by the color depth measurement, using an analyzer (VK ANALYZER)

(m) Area analysis

Analyze the entire region according to measurement analysis and two-dimensional analysis (n) Surface area analysis d Analyze the entire region according to measurement analysis and three-dimensional analysis (o) Number average particle size (NAPS)

$$NAPS = \text{(the total sum of the particle size in the entire region)}/\text{(the total sum of the particle numbers in the entire region)}$$

The symbols "○" and "x" in the matrix of FIG. 8 indicate a result of printing, and each means as follows:

○: Satisfy the print quality.

x: A print failure due to attachment of the external additive 27 to the charge roller 20 or a print failure due to marks resulting from long-term storage (long-term storage mark).

The evaluation results are results of continuous printing up to 20,000 sheets of the number of printing sheets, which is the developer device life, from the initial status, and printing evaluation results after leaving the developer device in an environment of 50 degrees of temperature and 55% humidity for one month, and they were synthesized and plotted. Conditions of the continuous printing test are as follows:

(1) Medium: A4 plain paper (2) Duty: 5% Beta (3) Number of sheets: 12,000 sheets (equivalent to 20,000 times of drum count)

(4) Environment: 0-4,000 sheets (temperature: 20 Celsius degrees, humidity: 15%), 4,001-8,000 sheets (temperature: 10 Celsius degrees, humidity: 15%), 8,001-12,000 (temperature: 28 Celsius degrees, humidity: 80%)

Herein, the duty can be defined as an area ratio. For example, when an entire area within all printable range of the sheet P is solidly printed, the area ration is defined 100%, and the duty is regarded as 100%. When the area ratio of such a solidly printing is n %, the duty at that time is regarded as n %.

The conditions for shelf test are as follows:

(1) Status: With ID mounted toner (2) Environment: Temperature: 50 Celsius degrees, humidity: 55%

(3) Time period: 720 hours

Out of the regions plotted with "x" in FIG. 8, it was confirmed that the region of printing failure due to the long-term storage marks shows the particle size D=21 μm or greater, and it was confirmed that the print failure occurs with S=3.1 or greater even if the particle size D=5 μm-20 μm (average diameter). This region is in a state where the particle size D is great or where the micro-particles 24 are deposited as shown in FIG. 6B.

Out of the regions plotted with "x" in FIG. 8, it was confirmed that a region of printing failure due to the attachment of the external additive 27 to the charge roller 20 shows the particle size D=4 μm or less, and it was confirmed that the print failure occurs with S=1.4 or less even if the particle size D=5 μm-20 μm (average diameter). This region is under a condition where the particle size D of the micro-particles 24 on the surface layer 23 is small, or a ratio of the micro-particles 24 added to the surface layer 23 is small, or a dispersion status of the micro-particles 24 is poor and the micro-particles 24 are not localized as shown in FIG. 7B. Under this condition, if the external additive 27 drops, the external additive 27 is deposited and adhered to the surface layer 23 as shown in FIG. 7B.

As described above, the region where no print failure occurs is a range plotted with "○", and the conditions are as follows:

$$\text{Particle size } D{:}5\ \mu m \leqq D \leqq 20\ \mu m \text{(average diameter)}$$

and $$\text{(Surface Area } Ss)/\text{(Area } Sa) = S{:}1.5 \leqq S \leqq 3.0$$

It is possible to avoid a print failure even with a long-term storage due to compressed permanent strain and to stably charge the photosensitive drum 13, even to the end of the life cycle of the device, by using the charge roller 20 satisfying these conditions. In addition, since no cleaning mechanism of the charge roller 20 is required, the cost is reduced.

Effect of First Embodiment

According to the first embodiment, if particles having an average particle size of 5 μm-20 μm (average diameter) are dispersed and contained in the outermost layer of the charge roller 20 and the value for the surface area/area is 1.5-3.0, no marks due to leaving the device standing occur on the charge roller 20, and a charge failure due to the attachment of the external additive 27 can be prevented. In addition, since no cleaning mechanism of the charge roller 20 is required, the cost is lower.

Second Embodiment

Configuration of Second Embodiment

A configuration of the image forming unit 10, the image forming device and the charge roller 20 in a second embodiment of the present invention is similar to that in FIG. 1, FIG. 2 and FIG. 3 of the first embodiment.

(Performance of Second Embodiment)

Performance of the image forming device and the image forming unit 10 is substantially the same as that of the first embodiment.

A charge roller 20B in the second embodiment is a charge roller having the following surface characteristics in addition to those in the first embodiment:

Ten-point average roughness $Rz:D/2 \leqq Rz \leqq D$; and

Maximum height $Ry:D \leqq Ry \leqq 2D$

Herein, the detailed definitions of Rz and Ry are described in JISB0601-1994.

For the measurement of the surface characteristics, a contact type surface roughness/contour shape measuring instrument (SFE-3500 manufactured by Kosaka Laboratory Ltd.) is used based upon JIS94. Since the particle size D of the micro-particles 24 is an average particle size, the particles in size naturally vary. Further, a particle array on the surface layer 23 does not also have any regularity, and they are uniformly dispersed to some extent. In the first embodiment, although the photosensitive drum 13 can be stably charged, a minute potential difference occurs in a local potential distribution. Under the conditions for Rz and Ry in the second embodiment, the charge roller 20 where a local potential difference is also inhibited is proposed.

Figure 10:
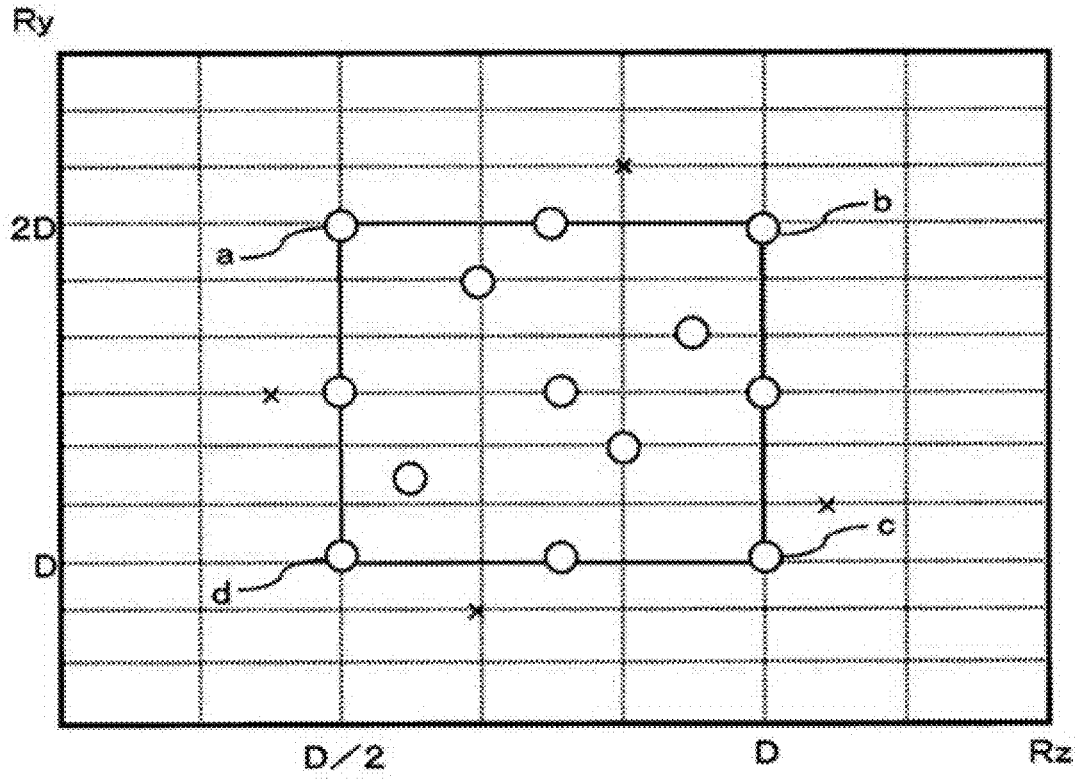
FIG. 10 is an explanatory graph illustrating a region of a surface characteristic of the charge roller enabling control of the local potential difference in a second embodiment of the present invention.

FIG. 10 is an explanatory diagram illustrating a region of the surface characteristics of the charge roller that can inhibit the local potential difference in the second embodiment of the present invention.

For the measurement of the surface characteristics in The second embodiment, samples with the particle size D=11-15 μm (average diameter), the surface area Ss/area Sa=S and S=2.1-2.5 were used. As a measurement result, the local potential difference becomes 10 V or less within a region surrounded with the area 'abcd' in FIG. 10.

A region where Rz is smaller than D/2, since the dispersion of the micro-particles 24 is poor and the asperity formation due to the micro-particles 24 is less, a potential difference greater than 10 V may occur. A region where Rz is greater than D, since the dispersion of the micro-particles 24 is poor and the micro-particles 24 agglutinate and it causes the asperity formation, a potential difference greater than 10 V may occur. A region where Ry is smaller than D, the variation of the particle size D of the micro-particles 24 is great and the comparatively small micro-particles 24 are localized or the micro-particles 24 are buried in the surface layer, and a difference greater than 10 V may occur as potential. In a region where Ry is greater than 2D, the particle size D of the micro-particles 24 greatly varies and the comparatively great micro-particles 24 are localized or the micro-particles 24 are deposited, and a difference greater than 10 V may occur as potential. Thus, the satisfaction of the conditions mentioned above enables to inhibit the local potential difference of the charge roller.

Furthermore, for the adjustment of Rz and Ry, there are the following methods:

(1) Change of the particle size of the micro-particles 24

(2) Change of the number of sections of the micro-particles 24

(3) Change of the coating speed of the surface layer 23

(4) Change of the number of coating times to the surface layer 23

(5) Change of the drying conditions for the surface layer 23

(6) Change of the finish roughness of the base layer

Effect of Second Embodiment

According to The second embodiment of the present invention, in addition to the effect of the first embodiment, the satisfaction of the conditions: $D/2 \leqq Rz \leqq D$, $D \leqq Ry \leqq 2D$, enables inhibition of the local potential difference of the charge roller 20.

MODIFIED EXAMPLE

The present invention shall not be limited to the first and second embodiments, but various utility forms and modifications are applicable. As these utility forms and modifications, for example, the following (a)-(b) are available:

(a) The present invention is not limited to a printer, but is generally applicable to image fanning devices, such as a multifunction machine (MFP), a facsimile device or a photocopier.

(b) In the first and second embodiments, although it was explained that since the charge roller 20 is pressed and deformed by the predetermined pressure of springs to the photosensitive drum 13, pressure is applied to the surface layer 23 in the shaft 21 direction, it may be configured to contact and press by thrusting the charge roller 20 into the photosensitive drum 13.

What is claimed is:

1. An image forming unit, comprising:

a rotatable electrostatic latent image carrier;

a charge member that is positioned to contact the electrostatic latent image carrier and that charges a surface of the electrostatic latent image carrier; and a developing part that supplies a developer to the electrostatic latent image carrier for obtaining a developer image, wherein the charge member includes a conductive elastic layer and a surface layer formed on a circumferential surface of the conductive elastic layer;

the surface layer contains particles having an average particle size of 5 μm-20 μm;

a ratio of a surface area per unit area of the surface layer is in a range from 1.5 to 3.0, the ratio of the surface area per unit area of the surface layer is calculated from a formula Ss/Sa; and the surface area of the surface layer is Ss and the area of the surface layer is Sa.

2. The image forming unit according to claim 1, wherein the surface layer is composed with a binder resin and the particles, and the particles are contained in a dispersed manner in the surface layer.

3. The image forming unit according to claim 1, wherein when the diameter of the particles is D, a ten-point average roughness of the surface layer Rz is D/2 or greater, and a maximum height Ry of the surface layer is 2D or less.

4. The image forming unit according to claim 1, wherein an outer shape of the charge member is cylindrical, a shaft extends along an axis of the charge member; and the conductive elastic layer is formed on an outer circumference of the shaft.

5. The image forming unit according to claim 1, wherein a surface layer is formed on the outer circumferential surface of the conductive elastic layer.

6. The image forming unit according to claim 1, wherein an intermediate layer is formed between the conductive elastic layer and the surface layer.

7. The image forming unit according to claim 1, wherein the particles contain at least any one of carbon black, metal, a metallic oxide and an ionic compound.

8. The image forming unit according to claim 1, wherein the electrostatic latent image carrier is a photosensitive drum.

9. An image forming unit, comprising:

an electrostatic latent image carrier, wherein an electrostatic latent image is formed on a surface of the electrostatic latent image carrier; and a rubber roller that contacts the electrostatic latent image carrier, wherein the rubber roller has an axial shaft, a conductive elastic layer formed about an outer circumference of the shaft, and a surface layer formed on an outer-circumferential surface of the conductive elastic layer;

the surface layer contains particles, which have an average particle size of 5 μm-20 μm, in a dispersed manner;

a ratio of a surface area per unit area of the surface layer is in a range from 1.5 to 3.0;

the ratio of the surface area per unit area of the surface layer is calculated from a formula Ss/Sa; and the surface area of the surface layer is Ss and the area of the surface layer is Sa.

10. The image forming unit according to claim 9, wherein the surface layer is composed with a binder resin and the particles, and the particles are contained in a dispersed manner in the surface layer.

11. The image forming unit according to claim 9, wherein when the diameter of the particles is D, a ten-point average roughness of the surface layer Rz is D/2 or greater, and a maximum height Ry of the surface layer is 2D or less.

12. The image forming unit according to claim 9, wherein the surface layer is formed on the outer-circumferential surface of the conductive elastic layer.

13. The image forming unit according to claim 9, wherein at least an intermediate layer is formed between the conductive elastic layer and the surface layer.

14. The image forming unit according to claim 9, wherein the particles contain at least any one of carbon black, metal, a metallic oxide and an ionic compound.

15. The image forming unit according to claim 9, wherein the electrostatic latent image carrier is a photosensitive drum.

16. The image forming unit according to claim 1, wherein the image forming unit is part of an image forming device that includes:

a carrying part that carries a sheet;

a transfer part that transfers the developer image onto the sheet from the image forming unit;

a fusing part that fuses the developer image transferred onto the paper by the transfer part; and an ejector that ejects the sheet on which the developer image is fused.

17. The image forming unit according to claim 1, wherein the surface area being Ss includes a surface area that includes asperity created with particles being dispersed on the surface area; and the area being Sa is a flat surface area that excludes the asperity created with the particles.

18. The image forming unit according to claim 9, wherein the surface area being Ss includes a surface area that includes asperity created with particles being dispersed on the surface area; and the area being Sa is a flat surface area that excludes the asperity created with the particles.

* * * * *